US005831543A

United States Patent [19]

Finkle

[11] Patent Number: 5,831,543

[45] Date of Patent: Nov. 3, 1998

[54] FIRE ALARM GLASS COVER FRAME

[76] Inventor: Louis J. Finkle, 3300 E. 59th St., Long Beach, Calif. 90805

[21] Appl. No.: 846,176

[22] Filed: Apr. 28, 1997

[51] Int. Cl.[6] ..... G08B 23/00

[52] U.S. Cl. ..... 340/693; 340/287; 340/303

[58] Field of Search ..... 340/693, 303, 340/304, 305, 301, 287, 307, 308, 289, 286, 300, 302

[56] References Cited

U.S. PATENT DOCUMENTS

| | | | |
|---|---|---|---|
| 412,971 | 10/1889 | Milliken | 340/303 |
| 663,767 | 12/1900 | Livingston | 340/303 |
| 904,889 | 11/1908 | Nicholson et al. | 340/303 |
| 949,699 | 2/1910 | Doughty et al. | 340/303 |
| 1,738,531 | 12/1929 | Grace | 340/303 |
| 3,872,999 | 3/1975 | Fudge | 220/266 |
| 4,046,439 | 9/1977 | Lee | 312/138 R |
| 4,598,893 | 7/1986 | Stobbart | 248/548 |
| 4,941,716 | 7/1990 | Rome et al. | 312/205 |
| 5,437,366 | 8/1995 | West et al. | 206/317 |
| 5,555,938 | 9/1996 | Tzeng | 169/36 |

*Primary Examiner*—Nina Tong

[57] ABSTRACT

A frame for supporting a sheet of glass over a fire alarm signal switch mounted on a wall. The frame is of the type which holds the glass over the switch so that the alarm signal can only be operated by breaking the glass. The frame has a cover member with an open bottom so that when the glass is broken to operate the alarm the resulting shards of glass fall through the open bottom of the cover member so that they do not injure the operator.

3 Claims, 2 Drawing Sheets

FIRE ALARM GLASS COVER FRAME

BACKGROUND OF THE INVENTION

The field of the invention is safety devices and the invention relates more particularly to fire alarm switches. Fire alarm switches can provide a temptation for vandals to surreptitiously pull the fire alarm switch while walking by. It has been found that this sort of vandalism can be greatly reduced by providing a sheet of breakable glass over the switch. In this way the breaking of the glass creates a very distinctive sound which would call attention to a potential vandal. As the result, alarm switches with glass covers are rarely pulled by vandals.

One problem with such switches, however, is that when the glass is broken for the purpose of sounding a fire alarm, the user needs to reach into the alarm box and pull out the fire alarm switch lever. Occasionally the broken shards of glass resulting from the breaking of the glass cover are held up in such a way by the bottom of the cover so that the user is cut while attempting to sound the alarm.

BRIEF DESCRIPTION OF THE INVENTION

It is an object of the present invention to provide an alarm box which has a reduced tendency to cut a user.

The present invention is for a frame for supporting a sheet of glass over a fire alarm signal switch mounted on a wall. The frame is of the type where the sheet of glass must be broken to reach the fire alarm signal switch. The frame has an inner frame member which is held against the wall and the inner frame member has four arms extending outwardly from the wall to four glass supporting tabs. The inner frame member includes means for attachment of a cover member. A cover member is attached to the inner frame member and has a top wall, a first and a second side wall and a face with a glass exposing opening having an inner surface. The cover member has an inwardly directed glass supporting ledge at the bottom of the face and the bottom of the cover member is generally open. A sheet of glass is held against the inner surface of the face of the cover member by said four glass supporting tabs. The sheet of glass is shaped so that it about extends to the top wall, first and second side walls and the glass supporting ledge. When the glass is broken into shards the shards will fall downwardly out of the generally open bottom and not be held where they might cut the operator of the fire alarm switch. Preferably the inwardly glass supporting ledge extends from the first side wall to the second side wall. Also preferably the glass supporting ledge extends inwardly a slightly greater distance than the thickness of the glass so that no sharp edges of the glass are exposed.

DESCRIPTION OF THE PREFERRED EMBODIMENTS

Figure 1:
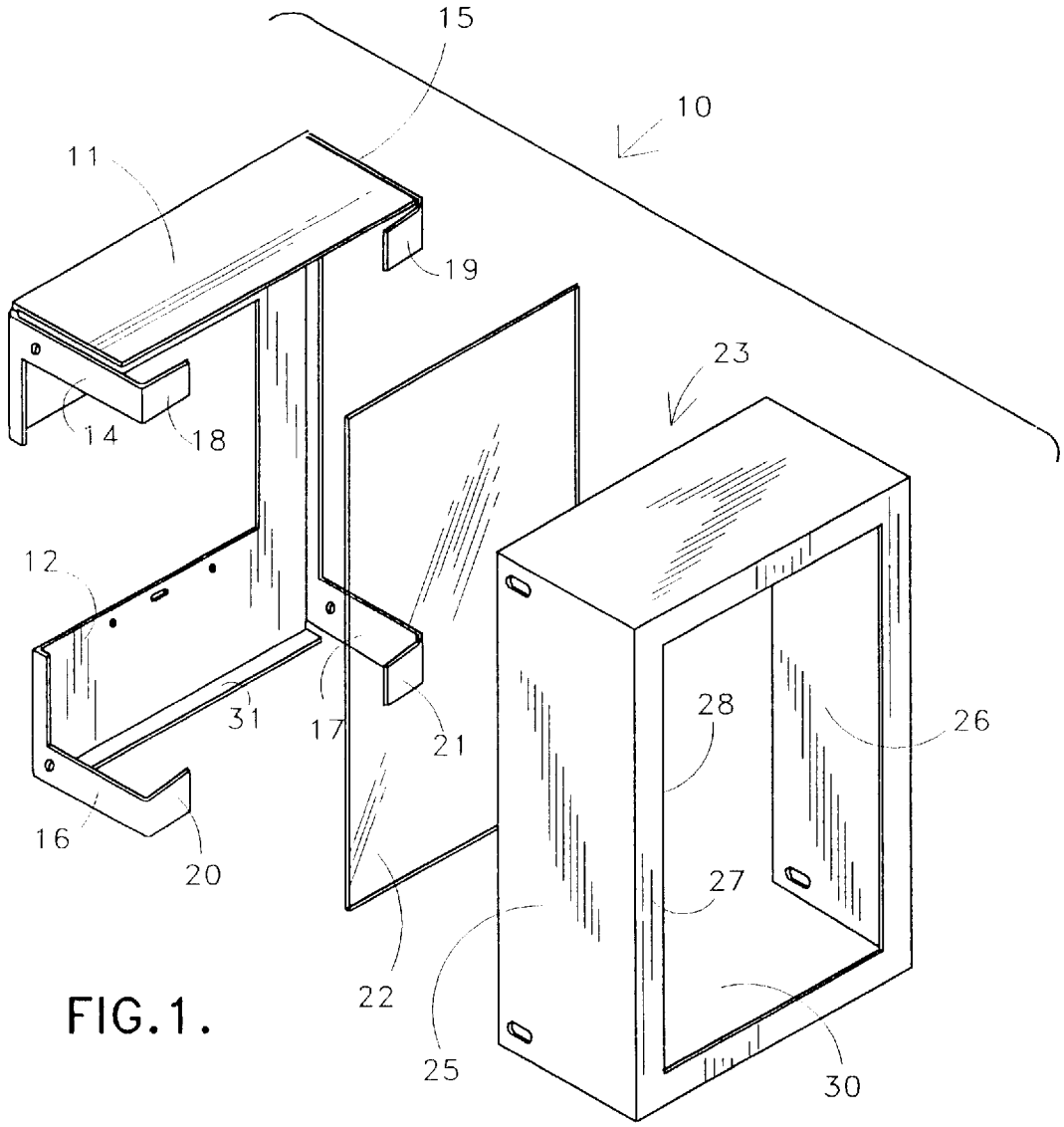
FIG. 1 is an exploded perspective view of the frame for supporting a sheet of glass of the present invention.

The frame for supporting a sheet of glass is shown in exploded perspective view in FIG. 1 and indicated generally by reference character 10. Frame 10 has an inner frame member 11 which has a back wall 12 which is screwed or otherwise affixed to a building wall indicated by reference character 13 in FIG. 4. Inner frame member 11 has four outwardly extending arms 14, 15, 16, and 17 which in turn have glass supporting tabs 18, 19, 20, and 21.

A sheet of glass 22 is sandwiched between the inner frame member 11 and cover member 23. Cover member 23 has a top wall 24, a first side wall 25, a second side wall 26 and a face 27. Face 27 has a glass exposing opening 28 in it so that it is largely open. The bottom of cover member 23 is almost entirely open except that there is an inwardly directed glass supporting ledge 29 shown in FIG. 2 which holds the bottom of the glass sheet 22.

Figure 3:
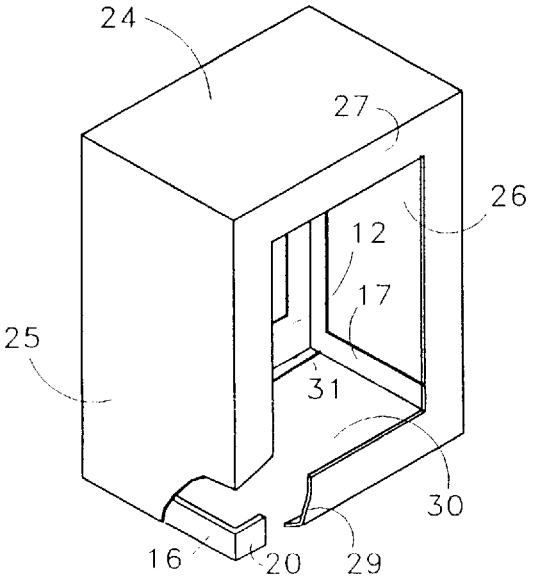
FIG. 3 is a perspective view partially cut away of the cover member and frame of FIG. 1.

The assembled frame member 11 and cover member 23 are shown in perspective view partly broken away in FIG. 3 where it can be seen that the bottom area 30 is generally open and only the inwardly directed glass supporting ledge 29 and a small reinforcing flange 31 extend at all into the generally open area 30.

Figure 4:
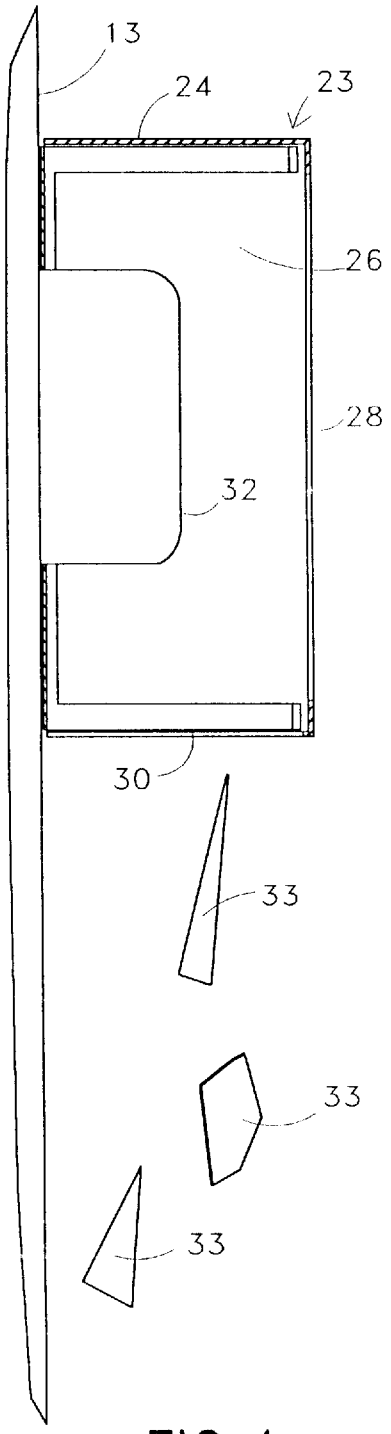
FIG. 4 is a cross-sectional side view of the frame of FIG. 1 mounted on a wall.
Figure 5:
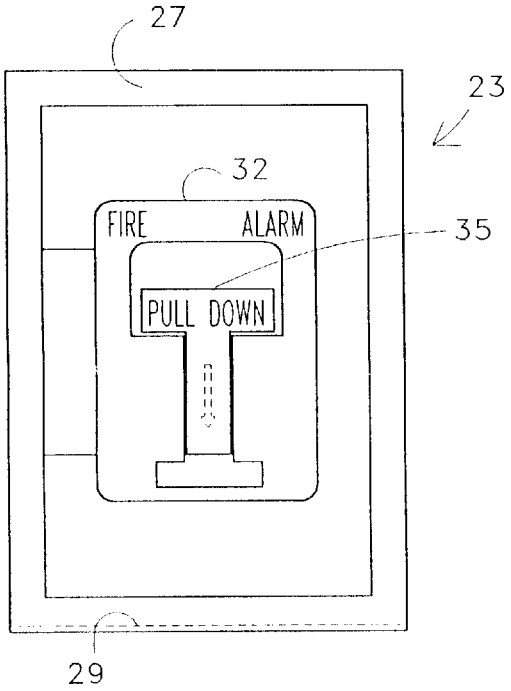
FIG. 5 is a front view thereof.

As shown in FIG. 4 a fire alarm signal switch 32 is surrounded by cover member 23. The sheet of glass 22 has been broken by a hammer held adjacent the assembly and the broken shards of glass are indicated by reference character 33 which have fallen downwardly through the open bottom 30 of cover member 23. Thus, when the user reaches in to pull down the switch 34 shown in FIG. 5, the user will not be cut by shards of broken glass which formerly have been supported on the bottom of the cover member after breaking.

Figure 2:
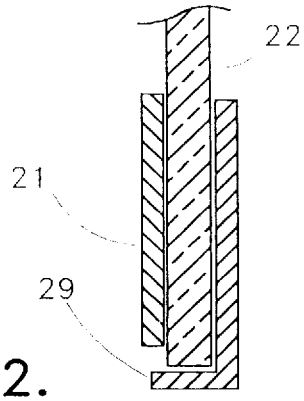
FIG. 2 is an enlarged cross-sectional view of the bottom of the cover member and of the sheet of glass of FIG. 1.

Preferably the sheet of glass 22 has a thickness less than the length of the inwardly directed glass supporting ledge 29 as shown in FIG. 2. In this way no sharp edge of the glass is exposed 21 reaching inside of the bottom of the cover member 23. Preferably ledge 29 extends from the first side wall 25 to the second side wall 26 so that no portion of the glass edge is exposed. This is shown in phantom view in FIG. 5.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A frame for supporting a sheet of glass over a fire alarm signal switch mounted on a wall, said frame being of the type where the sheet of glass must be broken to reach the fire alarm signal switch, said frame comprising:

an inner frame member held against said wall, said inner frame member having four arms extending outwardly from the wall to four glass-supporting tabs, said inner frame member including means for attachment of a cover member;

said cover member attached to said inner frame member, said cover member having a top wall, a first side wall and a second side wall and a face with a glass exposing opening having an inner surface, said cover member having an inwardly directed glass supporting ledge at the bottom of the face and the bottom of the cover member being generally open an amount sufficient so that the bottom of the cover member has a majority of its area open and said glass supporting ledge extending along the entire length of said sheet of glass; and said sheet of glass held against said inner surface of said face of said cover member by said four glass-supporting tabs, said sheet of glass being shaped so that it about extends to the top wall, the first and second side walls and said glass supporting ledge of said cover member whereby when said glass is broken into shards, the shards will fall rearwardly behind said inwardly directed glass supporting ledge and downwardly out of the generally open bottom and out of the cover member so that a user will not be cut by said shards when operating the fire alarm signal switch.

2. The frame for supporting the sheet of glass of claim 1 wherein said inwardly directed glass supporting ledge extends from said first side wall to said second side wall.

3. The frame for supporting the sheet of glass of claim 1 wherein said sheet of glass has a glass thickness and said glass supporting ledge extends inwardly a distance slightly greater than the glass thickness.

* * * * *